United States Patent [19]

Boyd

[11] Patent Number: 4,644,991

[45] Date of Patent: Feb. 24, 1987

[54] CORNICE ASSEMBLY

[76] Inventor: John A. Boyd, 5535 Columbia Pike, Arlington, Va. 22204

[21] Appl. No.: 731,295

[22] Filed: May 7, 1985

[51] Int. Cl.[4] ..... E06B 9/00

[52] U.S. Cl. ..... 160/38; 160/122; 160/241

[58] Field of Search ..... 160/19, 23 R, 38, 39, 160/108, 109, 110, 111, 112, 330, 334, 293 A, 294, 241, 25, 120, 122

[56] References Cited

U.S. PATENT DOCUMENTS

| | | | |
|---|---|---|---|
| 700,362 | 5/1902 | Niehaus | 160/23 R |
| 1,066,362 | 7/1913 | Bambas | 160/23 R |
| 1,177,862 | 4/1916 | Hammond | 160/23 R |
| 1,525,926 | 2/1925 | Eutin | 160/23 R |
| 1,601,665 | 9/1926 | Alphin | 160/112 |
| 1,810,146 | 6/1931 | Schollmeyer | 160/112 |
| 1,958,695 | 5/1934 | Claus | 160/23 R |
| 2,250,003 | 7/1941 | Boye | 160/39 X |
| 2,870,831 | 1/1959 | Peselnick | 160/241 X |
| 3,111,162 | 11/1963 | Bierlich | 160/19 |
| 3,788,376 | 1/1974 | Mednick | 160/19 |
| 3,996,987 | 12/1976 | Rodriguez | 160/38 X |
| 4,114,233 | 9/1978 | Hamilton | 160/38 X |

*Primary Examiner*—Ramon S. Britts
*Assistant Examiner*—David M. Purol
*Attorney, Agent, or Firm*—Donald A. Kaul

[57] ABSTRACT

A window cornice assembly including two spaced cornice terminals, two shade retaining brackets, and a tapestry cover assembly including a replaceable spring-loaded cartridge and a tapestry cover. The tapestry cover is an elongated sheet of material having two ends. The first end is attached to the spring-loaded cartridge and can be rolled up around the cartridge. The second, or free, end includes a fastening member. One of the cornice terminals includes brackets for rotatably receiving the spring-loaded cartridge. The other cornice terminal includes a receiving member to which the fastening member can be attached. The cartridge is inserted in the brackets and the tapestry cover pulled around the terminals until the fastening member is attached to the receiving member. The cartridge is easily removable from the brackets so that different cartridges containing different designs can be substituted as desired. The shade retaining brackets are attached to each terminal.

6 Claims, 4 Drawing Figures

CORNICE ASSEMBLY

FIELD OF THE INVENTION

This invention relates to window and door dressings. More particularly, it relates to cornice assemblies and similar structures for concealing curtain and drapery hardware.

BACKGROUND OF THE INVENTION

For centuries, decorators have employed cornices to cover up window hardware including drapery and curtain rods and support brackets. These cornices are designed to be attached to the wall adjacent the window and to extend at the top of the window from one side of the window to the other so that the drapery and curtain hardware is completely concealed. These prior cornices have been comprised of wood, metal or cloth, or a combination of these materials, as desired by the decorator.

The decorator usually chooses the appropriate cornice by examining the entire decor of the room, including the furniture, wall coverings and window dressings to be employed, as well as the scenery visible from the window. The cornice colors and design is selected to blend in with the other decorative features of the room to present an overall esthetic design.

The prior cornice assemblies are fixedly attached to the wall adjacent the window such that the cornice design cannot be modified without taking down the cornice structure. Therefore, once the prior cornices have been selected and installed, the design of the cornices or any designs on the exterior faces of the cornices cannot be modified without removing the entire cornice. This is obviously an extensive remodeling project.

This is a problem with the prior cornice assemblies as, at times, the person for whom the room is decorated may not like the cornice shape, design and/or color after it has been installed because it does not match the room decor as thought. Also, often a room decor may be changed including the wall covering or color, substitution of different furniture, etc. When the prior cornice assemblies are employed, the cornices cannot be modified to match the new decor without taking down the entire cornices and putting up substitute cornices. Not only does this take time and money, rendering any redecoration more expensive, it may also deteriorate the wall space adjacent the windows to which the cornices are attached.

Thus, the prior cornice assemblies present the problem that the decorative effect of the cornice cannot be modified without removing the entire cornice, at a relatively high expense and consumption of time. This increases the cost of remodeling a room, since the cost of entire cornices must be included within the remodeling costs.

Moreover, if the cornice is not esthetically pleasing once it has been put in place, the cornice cannot be modified in place but must be entirely removed and replaced by a new cornice. Thus, extreme care and caution must be employed in choosing a cornice. Also, these prior cornice assemblies are hard to install, often needing skilled labor to perform the installation. Since the prior cornices are often made of a stiff material, they may be hard to maneuver in place and difficult to attach to a wall.

It has also been known to have combination drapery, curtain and/or valance hardware so that the same brackets and rods may support all the window coverings for a particular window. However, these assemblies are hard to install and are relatively complex. Moreover, none of the known prior assemblies includes a cornice for concealing the hardware. Examples of these prior hardware assemblies are disclosed in U.S. Pat. Nos. 969,543; 1,636,601; 2,681,697; 2,752,117 and 3,788,376.

It is apparent from the foregoing that there is a need in the art for a cornice assembly which provides for a changeable design and which also supports drapery hardware. This invention fulfills this need in the art along with other needs apparent to those skilled in this art once given the following disclosure:

Generally speaking, this invention provides a cornice assembly comprising means for supporting the assembly, the supporting means being attachable to a wall, a spring-loaded roller cartridge, an elongated decorative cover having first and second ends, the first end being attached to the roller cartridge such that the cover may be rolled up around the cartridge, and at least one fastening member attached to the cover proximate the second end, wherein the supporting means includes means for rotatably receiving and engaging the cartridge, the supporting means further including means for engaging the fastening member.

In some embodiments of this invention, the supporting means includes first and second spaced terminals wherein the first terminal includes the receiving means and the second terminal includes the engaging means. Dividers may be provided for spacing the first and second terminals apart and to stabilize the assembly. The dividers may be rods which extend between portions of the first and second terminals and are attached on their respective ends to the terminals.

In further embodiments, the terminals may include shade receiving slots and a bracket located in the slots to rotatably engage a window shade and to guide the shade as it is lowered and raised. The shade may be housed within the cornice assembly by being attached to these brackets.

The spring-loaded cartridge may be received by the first terminal such that the spring-loaded cartridge is in a substantially vertical position. When so positioned, the cover can be unwound from the cartridge and pulled horizontally around the cornice terminals.

In some embodiments, the terminals may include a back face which is in abutment with the wall, a side face which extends outwardly from the wall back, and a front face which is located opposite the back face. The spring-loaded cartridge may be rotatably attached to the back corner between the back and side faces of the first cornice terminal. The cover engaging means may be located at the corner of the back and side faces of the second cornice terminal. In these embodiments, when the cover is fully withdrawn from the cartridge and attached to the second terminal, the cover will extend around the side face of the first terminal, the front face of the first terminal, between the first and second terminals, along the front fact of the second terminal and along the side face of the second terminal. Therefore in fact, the entire cornice assembly will be covered up by the tapestry cover.

This invention overcomes the problems of the prior art as discussed above by providing a cornice assembly wherein the exterior design of the cornice can be readily changed as desired. This gives a designer great flexibility when planning a room since many different cornice covers can be viewed in place before the final cornice cover is chosen. Also, the cornice cover can be easily changed if the room is remodeled at a later date. Moreover, the cornice covers are easy to install and, in fact, the entire cornice assembly can be installed by unskilled labor.

Therefore, it is a clear object of this invention to provide a cornice assembly with a changeable cornice cover so that the exterior design of the cornice can be readily modified if one is unhappy with the design of the cornice or if a room is remodeled such that the existing cornice does not match the new room decor.

It is a further object of this invention to provide a cornice assembly wherein the cornice cover can be changed so that one can redecorate a room by switching the cornice cover as desired.

Yet another object of this invention is to provide a cornice assembly which is easy to install.

A further object of this invention is to provide a cornice assembly which is relatively inexpensive to install initially and to modify as desired.

Yet another object of this invention is to provide a cornice assembly which supports a shade which may be drawn in front of the window.

One embodiment of this invention is illustrated in the attached drawings, wherein:

DETAILED DESCRIPTION OF THE DRAWINGS

Figure 1:
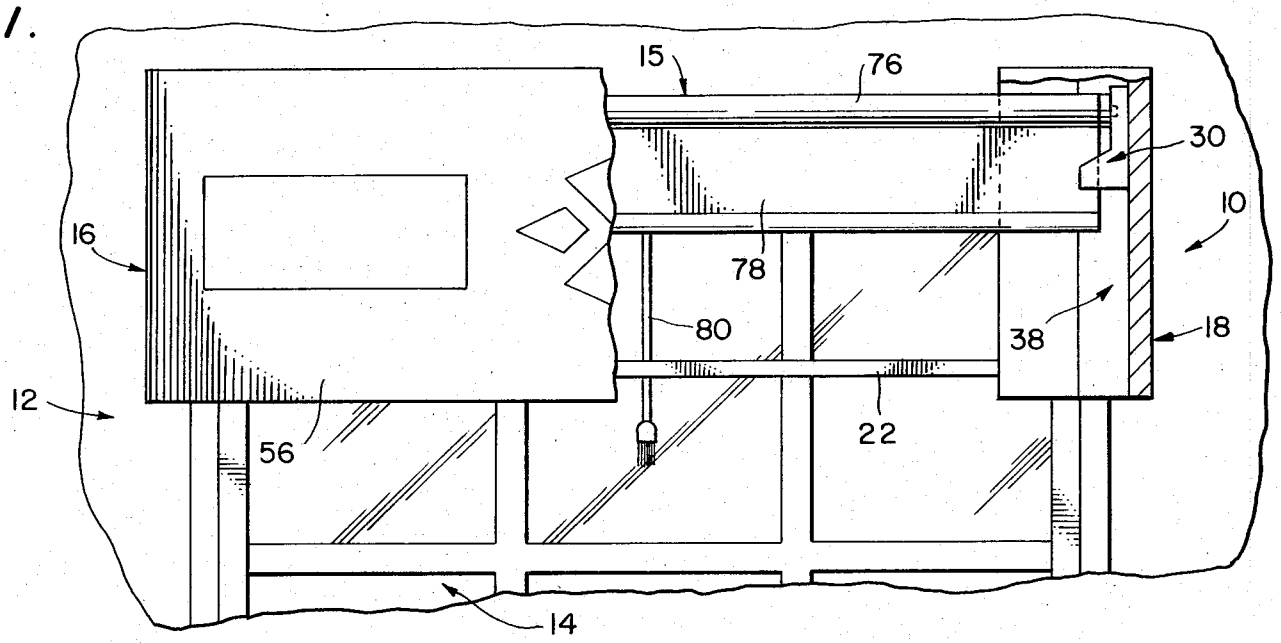
FIG. 1 is a front view of a cornice assembly according to this invention, partially sectionalized for clarity, with the cornice cover extending part of the distance across the front of the window.

Referring to FIG. 1, cornice assembly 10 is illustrated attached to wall 12 adjacent window 14. Cornice assembly 10 is positioned so that it conceals all the window dressing hardware and the top molding around the window. Window shade assembly 15 is provided to cover the window when desired.

Cornice assembly 10 includes a first or left cornice terminal 16, a second or right cornice terminal 18, an upper cornice terminal divider 20, a lower cornice terminal divider 22, outer curtain rod separator 24, inner curtain rod separator 26, tapestry cartridge assembly 28 and shade brackets and guides 30. Cornice terminals 16 and 18 are attached to wall 12 by any of the well known methods (not shown) of attaching brackets and other drapery hardware to a wall. Cornice terminals can be comprised of wood, metal, plastic or any other suitable material.

Figure 2:
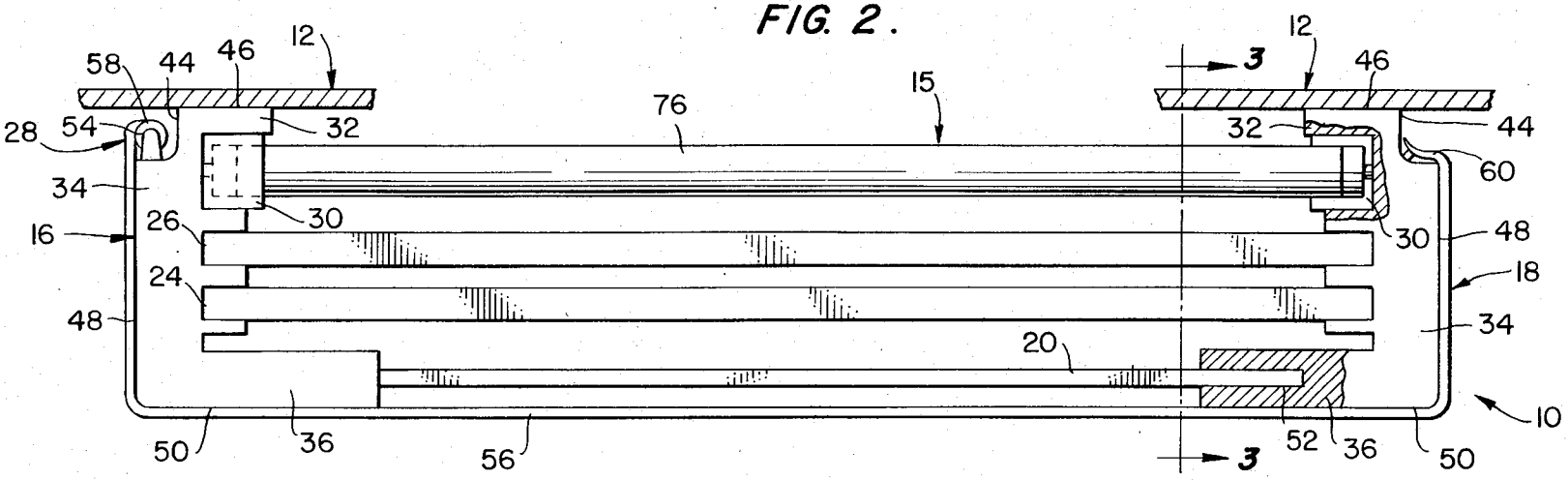
FIG. 2 is a top view of the cornice assembly illustrated in FIG. 1, partially sectionalized for clarity.
Figure 3:
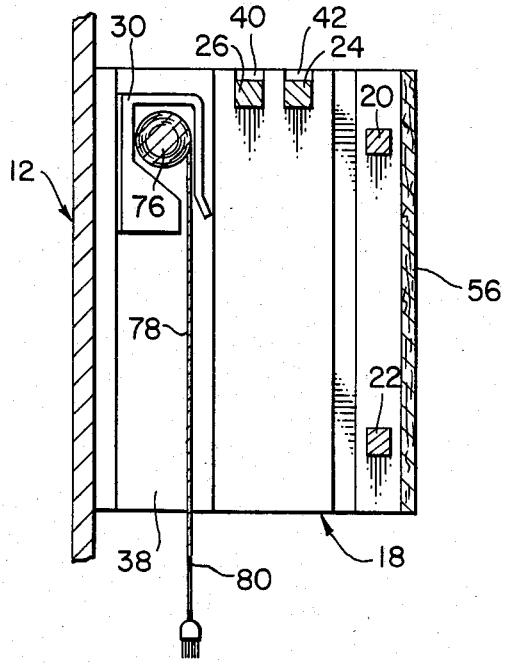
FIG. 3 is a left side view in section of the cornice assembly illustrated in FIGS. 1 and 2 taken along line 3—3 of FIG. 2.

Cornice terminals 16 and 18 each include a rear portion 32, a side portion 34, a front portion 36, a shade receiving slot 38, notches 40 and 42 and cutouts 44 (see FIGS. 2 and 3). Rear portion 32 has back wall 46 which is in abutment with wall 12 when the cornice assembly 10 is attached to wall 12. Side portions 34 have other side walls 48 which face away from each other. Front portions 36 have front walls 50 which face forwardly of window 14.

Shade receiving slots 38 extend vertically the height of terminals 16 and 18 and are designed to receive shade brackets and guides 30 and shade 78 therein. Notches 40 and 42 extend downwardly from the top of terminals 16 and 18 a desired distance and receive the ends of separators 24 and 26. Additional brackets (not shown) may be included in notches 40 and 42 to retain separators 24 and 26, as necessary. Cutouts 44 are located in the rear outer corner of terminals 16 and 18, for reasons discussed below.

Upper cornice terminal divider 20 and lower cornice terminal divider 22 extend between the front portions 36 of terminals 16 and 18. Dividers 20 and 22 are elongated rods of any shape cross section. The respective ends of the dividers 20 and 22 are received in bores 52 in the front portions 36, see for example the cutaway portion in FIG. 2. Dividers 20 and 22 stabilize cornice assembly 10 and also function to properly space terminals 16 and 18 apart.

Curtain rod separators 24 and 26 are inserted in notches 42 and 40, respectively, and add further stability to cornice assembly 10. In addition, if desired, curtains could be hung from curtain rod separators 24 and 26 for esthetic value.

Tapestry cartridge assembly 28 includes roller cartridge 54 and cornice cover tapestry 56. Cover tapestry 56 is an elongated piece or sheet of material with an esthetic effect. One end of tapestry 56 is attached to roller cartridge 54 which is spring-loaded such that cartridge 54 is always exerting a force attempting to wrap the tapestry around itself, much like a window shade. Tapestry 56 can be comprised of cloth, paper or plastic.

Left cornice terminal 16 also includes a pair of tapestry cartridge brackets 58 which engage and rotatably retain tapestry cartridge 54 the same as window shade brackets engage a window shade cartridge. These brackets are located in the cutout 44 in left cornice terminal 16 and are attached to this terminal.

Cornice assembly 10 also includes a fastening device 60 which has a first portion attached to the cutout 44 of the right cornice terminal 18 and a second portion located near the free end of cover tapestry 56. Such fasteners are well known in the art and thus are not illustrated in detail in the drawings.

Window shade assembly 15 includes shade cartridge 76 and shade 78. The ends of shade assembly 15 are received in shade brackets and guides 30. Shade brackets and guides 30 are attached to terminals 16 and 18 in shade receiving slots 38.

Figure 4:
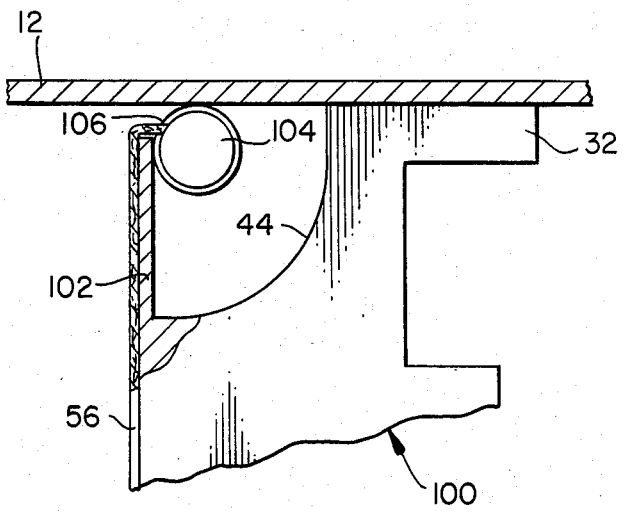
FIG. 4 is a partial top view, partially sectionalized for clarity, of a cornice terminal and shade assembly which can be employed in the practice of this invention.

In the embodiment illustrated in FIG. 4, cornice assembly 10 includes cornice terminal 100 attached to wall 12. Cornice terminal 100 is the same as cornice terminal 16 except that terminal 100 includes wall 102 which partially encloses cutout 44. The tapestry cartridge assembly is installed in cornice terminal 100 through the bottom of cornice assembly 10.

Also illustrated in FIG. 4 is tapestry cartridge 104. Tapestry cartridge 104 is a sealed container except for slots 106. The use of a sealed container renders the tapestry cartridge 104 easier to package, handle and ship. If desired, shade cartridge 76 could also be a sealed cartridge.

Operation

Cornice assembly 10 is employed by attaching the left and right cornice terminals 16 (or 100) and 18 to a wall, such as wall 12, adjacent window 14. Left cornice terminal 16 is located adjacent the upper left corner of the window and right cornice terminal 18 is located adjacent the upper right corner of the window. Shade brackets and guides 30, dividers 20 and 22, and separators 24 and 26 are installed in the terminals.

A shade assembly 15 can be inserted in the shade brackets and guides 30. A selected tapestry cartridge assembly 28 can then be inserted into brackets 58. Next, cover tapestry 56 can be unwound from tapestry cartridge 54 and pulled around side face 48 of terminal 16, front wall 50 of left terminal 16, between the respective terminals 16 and 18, along front face 50 of right cornice terminal 18, along side face 48 of right cornice terminal 18, until the fastening members are brought into engagement. Since tapestry cartridge 54 is spring-loaded, it will exert a force attempting to rewind tapestry 56 and will thus keep tapestry 56 taut.

When it is desired to change the tapestry cartridge 54, either to replace a worn tapestry or to change the design or color of the tapestry cover, fastening device 60 is unfastened and tapestry 56 is permitted to rewind onto tapestry cartridge 54. Cartridge 54 can then be removed from brackets 58 and a new cartridge inserted as it is desired. The new cartridge 58 can then be unwound, stretching around and between the cornice terminals and refastened at fastening means 60.

Once given the above disclosure, other improvements, embodiments and modifications will become apparent to those skilled in this art. Such other improvements, embodiments and modifications are considered to be within the scope of this invention as defined by the following claims.

What is claimed is:

1. A window dressing assembly comprising support means adapted to be attached along opposite sides of a window;

a first roller assembly rotatably attached to said support means and rotatable about a first axis;

a second roller assembly rotatably attached to said support means and rotatable about a second axis;

said first axis and said second axis being disposed perpendicularly to one another and both being parallel to the plane of the window;

said first roller assembly including a window shade mounted upon a spring-loaded cartridge which is rotatable about said first axis and adapted to be manually raised and lowered to selectively cover or expose the window;

said second roller assembly including a decorative sheet mounted upon a spring-loaded cartridge which is rotatable about said second axis and adapted to be manually drawn to an extended position wherein the decorative sheet projects laterally across the window to cover both the support means and the first roller assembly;

said support means including means to releasably fasten the decorative sheet in said extending position.

2. A window dressing assembly as defined in claim 1 wherein said first axis is horizontal and said second axis is vertical.

3. A window dressing assembly as defined in claim 2 wherein the window includes upper and lower ends and a pair of opposite sides, wherein said first axis is parallel to said upper and lower ends and said second axis is parallel to said sides.

4. A window dressing assembly as defined in claim 1 wherein said support means includes a pair of spaced attachement terminals, one of which carries said decorative sheet mounted upon a spring-loaded cartridge and the other of which carries said means to releasably fasten the decorative sheet.

5. A window dressing assembly as defined in claim 4 wherein said attachment terminals further include means for receiving and retaining the ends of the spring-loaded cartridge upon which said window shade is mounted.

6. A window dressing assembly as defined in claim 5 further including divider means attached to and extending between said attachment terminals, said divider means being disposed parallel to said first axis.

* * * * *